US007750292B2

(12) United States Patent
Finlay

(10) Patent No.: US 7,750,292 B2
(45) Date of Patent: Jul. 6, 2010

(54) MASS SPECTROMETER SYSTEM

(75) Inventor: Alan Finlay, Richmond (GB)

(73) Assignee: Microsaic Systems Limited, London (GB)

( * ) Notice: Subject to any disclaimer, the term of this patent is extended or adjusted under 35 U.S.C. 154(b) by 398 days.

(21) Appl. No.: 10/589,324

(22) PCT Filed: Jan. 13, 2005

(86) PCT No.: PCT/EP2005/050132

§ 371 (c)(1),
(2), (4) Date: Jun. 8, 2007

(87) PCT Pub. No.: WO2005/078429

PCT Pub. Date: Aug. 25, 2005

(65) Prior Publication Data

US 2007/0278401 A1 Dec. 6, 2007

(30) Foreign Application Priority Data

Feb. 12, 2004 (GB) ..... 0403122.5

(51) Int. Cl.
*H01J 49/04* (2006.01)

(52) U.S. Cl. ..... 250/289; 250/281; 250/288; 250/428; 250/430

(58) Field of Classification Search ..... 250/281–300, 250/423 R, 428, 430
See application file for complete search history.

(56) References Cited

U.S. PATENT DOCUMENTS 3,458,699 A * 7/1969 Padrta ..... 250/288
3,638,401 A * 2/1972 Kabler ..... 96/9
3,992,626 A * 11/1976 Bursack ..... 250/288
4,023,398 A * 5/1977 French et al. ..... 73/23.2
4,201,913 A * 5/1980 Bursack et al. ..... 250/288
5,019,139 A * 5/1991 LaPack et al. ..... 96/4
5,155,357 A 10/1992 Hemond
5,313,061 A * 5/1994 Drew et al. ..... 250/281
5,536,939 A * 7/1996 Freidhoff et al. ..... 250/281
5,703,359 A * 12/1997 Wampler, III ..... 250/288

(Continued)

FOREIGN PATENT DOCUMENTS

EP 0 433 936 A2 6/1991

(Continued)

OTHER PUBLICATIONS

Lapack, Mark A., et. al., "Valved Sampling Cell for Membrane Introduction Mass Spectrometry," Analytical Chemistry, 1996, pp. 3072-3075, vol. 68, No. 17.

(Continued)

*Primary Examiner*—Bernard E Souw
*Assistant Examiner*—Michael J Logie
(74) *Attorney, Agent, or Firm*—Bishop & Diehl, Ltd.

(57) ABSTRACT

A portable mass spectrometer system is described. The system includes a mass spectrometer device incorporated within an evacuated chamber. The chamber includes a permeable membrane located between the mass spectrometer device and an entrance port to the chamber. Located between the membrane and the entrance port is a valve. The valve is provided in an normally closed state and has an open state, such that, in use, the adoption of the open state allows the flow of the sample into the chamber through the membrane and into contact with the spectrometer device.

16 Claims, 2 Drawing Sheets

U.S. PATENT DOCUMENTS

| | | | | |
|---|---|---|---|---|
| 5,994,696 | A * | 11/1999 | Tai et al. | 250/288 |
| 7,247,847 | B2 * | 7/2007 | Webb et al. | 250/293 |
| 7,367,216 | B2 * | 5/2008 | Bonne | 73/25.01 |
| 7,385,191 | B1 * | 6/2008 | McMurtry et al. | 250/288 |
| 7,427,750 | B2 * | 9/2008 | Grossenbacher et al. | 250/288 |
| 2003/0020011 | A1 * | 1/2003 | Anderson et al. | 250/287 |
| 2004/0149903 | A1 * | 8/2004 | Wang | 250/292 |
| 2005/0017634 | A1 * | 1/2005 | Kamio et al. | 313/553 |
| 2005/0109932 | A1 * | 5/2005 | Mullock et al. | 250/288 |
| 2005/0279932 | A1 * | 12/2005 | Wang | 250/290 |
| 2008/0128605 | A1 * | 6/2008 | Wells et al. | 250/281 |

FOREIGN PATENT DOCUMENTS

| | | | |
|---|---|---|---|
| GB | 1224915 | | 3/1971 |
| GB | 2026231 | A * | 1/1980 |
| GB | 2 384 908 | A | 8/2003 |
| JP | 01077855 | A * | 3/1989 |
| JP | 2001155677 | A * | 6/2001 |
| JP | 2001-307673 | A | 11/2001 |
| JP | 2002357593 | A * | 12/2002 |

OTHER PUBLICATIONS

Great Britain Search Report, Jun. 25, 2004, GB.
PCT International Search Report, Oct. 19, 2005, WO.

* cited by examiner

MASS SPECTROMETER SYSTEM

This application claims priority from British Application No. 0403122.5 filed Feb. 12, 2004 (incorporated by reference herein), and International Application No. PCT/EP2005/050132 Jan. 13, 2005 (incorporated by reference herein).

FIELD OF THE INVENTION

The present invention relates to mass spectrometer systems and in particular to a system incorporating a mass spectrometer device formed using MEMS components. The invention more particularly relates to a system having a mass spectrometer device incorporated in a pre-established vacuum.

BACKGROUND OF THE INVENTION

Mass spectrometer systems are well known and are used in the analysis of various materials. Miniature mass spectrometer systems are also known and have applications as field-portable devices for use in the detection of biological and chemical materials such as warfare agents, drugs, explosives and pollutants. They are also used in space exploration and as residual gas analysers. Many systems of reduced size have been developed and micro-engineering methods are increasingly being used in their construction. Mass spectrometer devices consist of three main subsystems; an ion source, an ion filter and an ion counter. It is also important that, in use, the mass spectrometer device operates within a vacuum so as to enable accurate detection of the required material, such that a complete system includes a mass spectrometer device which is provided in an arrangement that allows operation of the device within vacuum conditions. In conventional laboratory based equipment such a vacuum is easily generated using standard vacuum techniques. Further information on the make up of such systems may be found in GB2384908 co-assigned to the assignees of the present invention.

It is also known to provide mass spectrometer devices as portable devices. In fact even before the development of miniaturised mass spectrometer devices, portable devices such as GB2026231 were known. Such a device includes a power pack and a hand held probe, the probe comprising a gas inlet with a porous membrane, an ion source which can also function as an ion pump, a quadrupole ion filter, an ion detector and a chemical getter agent to provide a vacuum within the probe. The spectrometer is intended for detecting chemicals in remote areas and does not require a conventional vacuum system. The system uses the ion source to create the vacuum necessary for operation of the mass spectrometer such that in use as a detector the ion source is configured as a source and during regeneration of the required vacuum the source is configured as a pump. Such modifications to the system that are required to provide the required vacuum necessary for the operation of the mass spectrometer device are cumbersome and complex. There is, therefore, a need to provide an alternative arrangement or system for establishing and operating a mass spectrometer device within a vacuum.

SUMMARY OF THE INVENTION

These and other problems associated with the prior art are addressed by a mass spectrometer device in accordance with the present invention. A first embodiment of the invention provides a mass spectrometer system including a mass spectrometer device provided within an evacuated chamber, the chamber having an entrance port through which a sample may be introduced into the chamber and into contact with the mass spectrometer device, the system additionally including a permeable membrane located across the chamber between the port and the spectrometer device and a valve located between the membrane and the entrance port and having an normally closed state and an open state, such that, in use, the adoption of the open state allows the flow of the sample into the chamber through the membrane and into contact with the spectrometer device.

The spectrometer device is desirably formed from a MEMS device.

The valve may be formed from a rupturable diaphragm sealing the evacuated chamber, the rupturing of the diaphragm breaking the seal and allowing the flow of the sample into the chamber. In preferred embodiments the valve is formed from a breakable glass member and an actuator, the glass member being located across the chamber and sealing the chamber, and wherein, in use, the actuator is adapted to come into contact with the glass member, breaking the member and consequently the seal.

The membrane is suitably formed from a polydimethylsiloxane material. This material may be formed as a liquid layer on a substrate, a polymerisation of the material on the substrate forming the membrane. Typically, if formed on a substrate the substrate is a metal mesh structure or a silicon based substrate.

The system may further include a second evacuated chamber, the first evacuated chamber being located within the first evacuated chamber, the pressure within the first evacuated chamber being less than that of the second evacuated chamber.

Such a second chamber desirably includes an inlet and an outlet tube, the inlet tube being adapted to enable an introduction of a sample from outside the second chamber into contact with the spectrometer device located within the first chamber, the outlet tube being adapted to enable a venting of gas from the second chamber.

A pump may be provided on the outlet tube, the pump adapted to effect a reduction in pressure of the second chamber.

In the normally closed position of the valve, the pressure within the evacuated chamber is less than $10^{-4}$ Torr, typically of less than $10^{-6}$ Torr and preferably about $10^{-8}$ Torr.

When provided with a pump, the pressure within the second chamber is desirably reduced to about $10^{-1}$ Torr.

The invention also provides a system substantially as hereinafter described with reference to the accompanying drawings.

BRIEF DESCRIPTION OF THE DRAWINGS

The present invention will now be described with reference to the accompanying drawings in which.

DETAILED DESCRIPTION OF THE DRAWINGS

The invention will now be described with reference to FIGS. 1 to 3.

Figure 1:
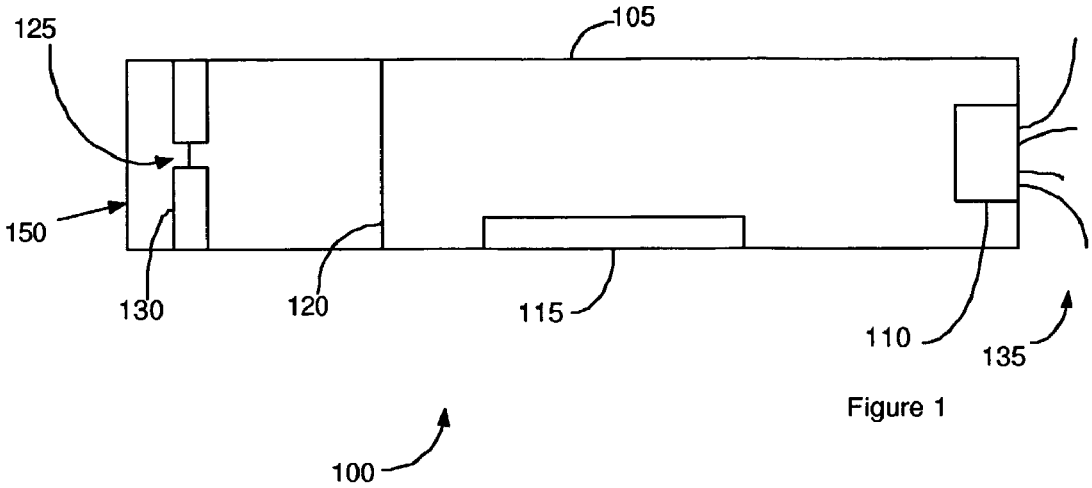
FIG. 1 is a schematic of a mass spectrometer device in accordance with a first embodiment of the present invention.

FIG. 1 is a schematic arrangement of a mass spectrometer system 100 in accordance with the present invention. The device 100 includes a vacuum chamber 105 within which is mounted a mass spectrometer device 110. Although not shown in this schematic the device 110 includes an ion source and an ion detector. The mass spectrometer device is typically mounted at one end of the chamber, at an end distally located from an entrance port 150 of the chamber. Desirably, the device 110 is formed using MEMS technology and is mounted on a PCB board. For most applications it is found that the use of ceramic-based PCB materials provides better results in that the ceramic material does not outgas during use of the system. A pressure transducer may also be mounted on the PCB board, although again in this schematic it is not explicitly shown. If incorporated a pressure transducer may be used to monitor the pressure within the chamber, both for information purposes but also as a control system. When the pressure within the chamber raises above a certain minimum level, the operation of the system is not as satisfactory and it is therefore sometimes important to have an indicator of when this is occurring so as to change the operational parameters.

For a mass spectrometer to operate the ions must move under the influence of magnetic or electric fields without frequent collisions with other ions or molecules. This means that a pressure of typically less than $<10^{-4}$ Torr must be maintained. $1\times10^{-6}$ Torr is considered to be normal practice, although with use of MEMS quadrupole mass spectrometer devices, with their smaller dimensions, higher pressures can be used.

A getter material, such as caesium may be provided within the chamber in the form of a tablet 115 or for example as an internal coating formed on the inner walls of the chamber, the choice of getter material being chosen to absorb suitable gases during storage and operation of the system. The type of getter material is typically chosen for the specific application with which the mass spectrometer system will be used, as will be appreciated by those skilled in the art.

At an end of the chamber, remote from the positioned mass spectrometer device 110, a permeable membrane 120 is formed. The membrane is provided across the entire inner diameter of the chamber and is adapted to enable a slow dissipation of the vacuum conditions within which the device 110 is disposed. The membrane is provided between the spectrometer device and the entrance port.

The system is normally provided with a breakable seal, such that when sealed the vacuum conditions within the chamber are maintained and when broken, that the vacuum will slowly dissipate until the pressure within the chamber is the same as the pressure outside the chamber. Such a breakable seal may be formed in variety of different ways such as a breakable glass member 125 sealed and mounted on the supporting flange 130. In use, the glass may be broken and the membrane 120 is then exposed to the ambient pressure outside the chamber and due to the pressure difference between the two sides of the membrane gases will percolate across the membrane where they interact with the spectrometer device and also lead to a resulting increase in the pressure within the chamber. The seal is formed from a valve or some other sealing or closure means, and is provided in a normally closed position such that the evacuated conditions within the chamber are maintained. Once opened, sample material may percolate into the chamber, thereby raising the pressure within the chamber. The seal is provided between the membrane and the entrance port.

One or more connection or power leads 135 are provided through the walls of the vacuum chamber so as to provide the required power to the mass spectrometer device. Most of the leads are used for connecting low DC or RF components of the mass spectrometer device, but other components such as the detector require voltages of the order of a few thousand volts for operation. The connection through the chamber is such so as to maintain the hermetically sealed conditions of the chamber. Such techniques will be well known to those skilled in the art of the manufacture of vacuum containers or chambers or hermetically sealed packages as found in the field of optoelectronics.

It will be appreciated that the vacuum conditions provided within the chamber of the present invention may be destroyed by effecting a break in the seal at the end of the chamber. For use of the device there must be a way for gas to permeate the containment, and obviously, having a solid wall of metal will not allow this. One possibility is to have valves that can be opened when the device is to be used. There are a number of valve designs, ranging from bellows, diaphragm, gate and ball. However valves for vacuum systems, tend to be large and it is difficult to provide sizes suitable for the device. While a specialist valve could be designed, this is unlikely to be a satisfactory solution, as a large valve closing area is required for low leaking, and thus a small valve would likely suffer from high leak rates. Another idea would be to have an inlet pipe, which while in storage is "blocked" and is "unblocked" when required. A common method to block up containers with vacuum is to melt a glass container together. This is commonly done with CRT's. To unblock the seal, the glass could be melted, but this would not be desirable for commercial use and the high temperature needed to melt the glass if not done locally could be detrimental to the device and its containment. A similar idea would be to use a solder, which could be melted to remove the block, but again the heating and removal of the solder would have to be done carefully. A final method would be to have a "soft spot" such as a thin or different material in the containment that could be punctured. The use of a thin section of steel, which could be punctured, is possible, however to make it easily puncturable, the wall would have to be substantially thin (depending on area of puncture). A thick wall would require a lot of force, and a large area would result in substantial deformation before breaking. An alternative is to use a more brittle material for puncturing through.

Figure 2:
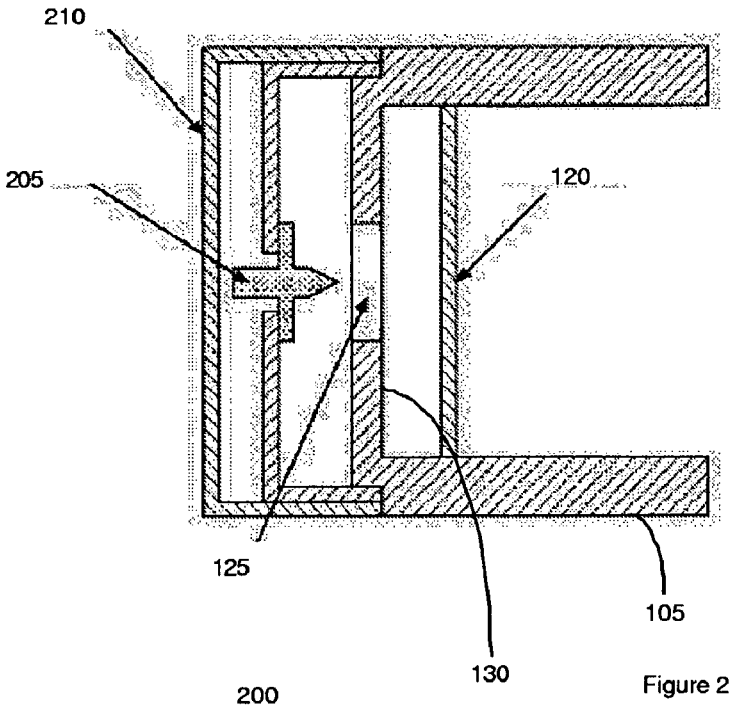
FIG. 2 is a detail view of an arrangement for breaking the vacuum seal of the device of FIG. 1.

A further preferred technique which was mentioned previously in the discussion of FIG. 1 and which will be described now with reference to FIG. 2 is to use a glass wall 125 which is mounted within the chamber and which can be broken. Even by just cracking the glass, sufficient gas will be able to traverse through into the containment. The glass section can be designed such that a sharp blow could break it. A possible method would be a metal pin 205 which could be brought down on the surface. During non-use of the system, the pin 205 would be covered by a cap 210, to ensure that the pin does not accidentally come into contact with the glass, thereby accidentally breaking the vacuum.

Material Chosen

It will be appreciated that the choice of material used in the formation of the vacuum chamber 105 is very important. The material must be capable of standing the pressure imposed by the vacuum, and must not be detrimental to the sustaining of it. A suitable material is stainless steel. Stainless steel grades 304 and 316 are recommended as both have excellent corrosion resistance in a wide range of conditions. Both are resistant to organic chemicals and a wide variety of inorganic chemicals, and can be readily cleaned. Both grades have very low magnetic permeability, and can be easily welded. Grade 316 is more resistant to pitting and crevice corrosion in warm chloride environments, compared to 304 and is often chosen for more aggressive environments such as sea-front buildings and fittings on wharves and piers.

The system of the present invention is adapted to be available as a ready to use package, which can be stocked for use as needed. To be viable, the shelf life should be reasonable, which is determined by the time taken to compromise the internal vacuum, so that the device can not operate (or operate for long enough). An assessment of the possible causes of vacuum compromising and their importance is detailed below.

The sources of gas in an enclosed vacuum system are; desorption, evaporation, diffusion/permeation and leaks. Leaks can be classified into two types of leak, virtual and true. Virtual leaks occur when air is trapped, such as in between 2 welds or in an un-vented screw. True leaks are actual paths from the atmosphere to the vacuum. Evaporation results from the components within the vacuum vaporising in vacuum. Desorption is dependant on the material, treatment, temperature, and exposure time, and is mainly the result of evolution of gasses dissolved in the solid, or reduction of surface layers. It is a function of molecular binding energy, temperature of the surface and number of monolayers formed on the surface.

Diffusion or Permeation results from the passage of gas from the atmosphere through the vacuum wall material and into the vacuum chamber and can be considered as a 3 step process:

1. The gas adsorbs onto outer wall of vacuum chamber. 2. The gas diffuses through chamber wall. 3. Gas desorbs from interior of chamber wall.

The determining step for the transfer of gas (at least for metals) is the diffusion through the solid.

Considering a vacuum chamber manufactured from steel, If it is assumed that the containment is in steady state, is manufactured well, and also the containment has been outgassed for a sufficient time, it can be assumed that leaks, both real and virtual can be discounted. Virtual leaks have been avoided, or have had time to become negligible in the vacuum. Real leaks are not accounted for. Evaporation can be neglected, as the vapour pressure of steel is extremely low, well below the pressure ranges being examined for the device. Desorption of surface layers or trapped gases will be negligible, ensured by the vacuum bakeout. Considering the permeation gas path only, and using Richardson's equations it can be shown that in an ideal containment chamber having pure steel walls and neglecting other sources of leaks, the pressure increase after a year is negligible, compared to the required system pressure of $10^{-8}$ Torr ($1.33*10^{-6}$ Pa) and would give a shelf life of about 10 years. Although stainless steel is a preferred material it will be appreciated that this is exemplary of the type of material that may be used in the manufacture of such chambers and it is not intended to limit the manufacture of the chamber of the system of the present invention to any one type of material.

Membrane Material

For operation of the spectrometer device of the present invention, a supply of sample gas must be made available, without causing too high a leak rate to stop the device from operating. MIMS (Membrane Introduction Mass Spectrometry) uses a membrane to separate the gas source from the vacuum chamber, slowly allowing gas to permeate through it The most common membrane material is PDMS (polydimethylsiloxane), which is especially useful for measuring volatile organic compounds (VOC's) as the PDMS has a preferential affinity for these molecules compared to others such oxygen and nitrogen. This has the advantage that the gas mixture passing through is enriched, helping with the detection of compounds that would not be detectable otherwise. Polysiloxanes have been extensively studied over many years, and are comprised of silicon atoms bonded to oxygen. Silicones are intermediates between organic and inorganic compounds, specifically between silicates and organic polymers. The compound is very stable—eg degradation of PDMS occurs after ±350° C. The sudden pressure increase by allowing gasses to pass through into the interior portion of the vacuum container must be withstandable by the membrane. This may require support of the membrane to avoid deformation or associated problems.

Unfortunately the measurement of polar compounds is also limited with polydimethylsiloxane, as the membrane is hydrophobic and polar compounds do not easily diffuse through it at room temperature. A recently introduced technique—desorption chemical ionisation MIMS—combines Chemical Transport-Membrane Introduction Mass Spectrometry (CT-MIMS) and Chemical Ionisation (CI), making it possible to detect compounds with high boiling points, e.g. acids and other compounds. It will be appreciated that the choice of material used in the formation of the membrane may be chosen for specific applications of the mass spectrometer device. It will be understood that although certain materials may be used for the detection of polar compounds and others for identification of acids etc. Also the provision of the membrane may be in one or more arrays or alternative combinations.

Although the material chosen for the membrane is specifically chosen to allow a slow percolation of material into the vacuum chamber with a resultant slow breakdown of the vacuum conditions, it will be appreciated that due to the large pressure gradient across the membrane that it is possible for the time between breaking the seal and the loss of the pressure gradient across the membrane can be reduced to a time of such short duration that it is not practical for analysis purposes. The effect of membrane thickness has been investigated. Although a thicker membrane is easier to mount within the chamber and does result in slower percolation times, non-linearity effects are introduced. Also a thick membrane will reduce the response time of the system, as well as making it hard to detect VOC's and high boiling point temperature compounds (such as many acids). However, this may be acceptable for detection of VOC's. In order to provide a thinner membrane, which is easily mountable within the chamber it is possible to lay some PDMS material as a liquid on a semi porous surface and polymerise it on that surface. Suitable semi-porous surfaces include silicon and metal meshes. The supporting substrate may then be mounted directly to an inner wall of the chamber.

Changing the Flow Rates Through the Membrane

To reduce the flow through the membrane without sacrificing the area, the membrane thickness could be increased, or alternatively the partial pressure difference ($\Delta p$) across the membrane could be reduced. The partial pressure difference, $\Delta p = p2 - p1$, where p2 is the pressure outside the vacuum chamber and p1 is the pressure within the chamber, As long as $p2 >> p1$, $\Delta p$ is substantially equivalent to p2. It will be appreciated that if the pressure difference is reduced that the device operation time will increase. At atmospheric pressure, p2 is 760 Torr, while p1 is about $10^{-4}$ Torr, so this holds true. If the high pressure side was reduced down to say 1 Torr, p2 (1 Torr) is still far greater than $10^{-4}$ Torr, so the equality holds. Due to the proportionality of pressure and flow through rate, by reducing the pressure to 1 Torr, the time taken for the pressure to rise for a given membrane would be increased by 760 times. To reduce the pressure down to 1 Torr (1.32 millibar)—which is only a rough vacuum, is relatively simple, and does not require much hardware in comparison to high vacuums. Therefore it will be appreciated that rather than increasing the dimensions of the membrane it is possible to increase the operational time of the system by reducing the pressure gradient across the membrane. FIG. 3 shows an example of a modification of the system of the present invention to provide such a reduction in the pressure gradient.

Figure 3:
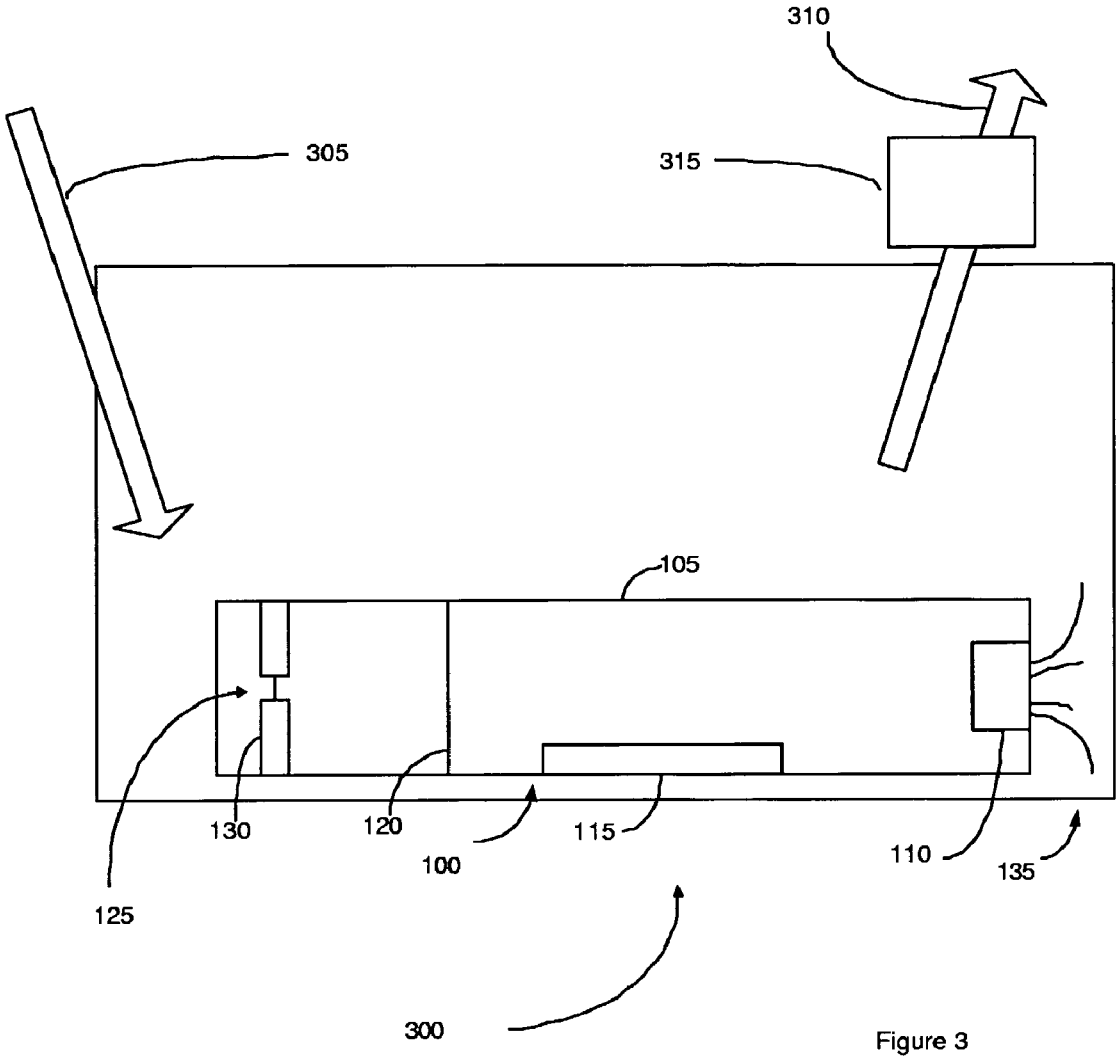
FIG. 3 is a schematic showing the incorporation of the device of FIG. 1 into an external mating arrangement adapted to provide external operational conditions at a pressure less than ambient atmospheric pressure.

In the embodiment of FIG. 3, the system of FIG. 1 is mounted within a sealed container 300 with an inlet 305 and outlet 310 tube or vent. This sealed container 300 forms a second chamber of the system, the first being the evacuated chamber incorporating the mass spectrometer. The inlet tube is adapted to enable a sample material from outside the container 300 to be introduced to the system, such that constituent material may be examined. The tubes are desirably formed from a PTFE material or some other equivalent. A pump 315 is provided so as to reduce the pressure within the container, and is desirably provided on the outlet vent 310. Suitably the pump chosen is of the type known as a roughing pump. Such pumps are available as both dry and wet varieties and due to the application within the context of the present invention it is preferable that the pump is a dry pump such that the operation of the pump does not infect the air quality thereby degrading the accuracy of the result of the system. If a pressure transducer is included within the vacuum chamber, the pressure transducer could be used to monitor the pressure and to effect an activation of the pump in the second chamber.

In tests it has been shown that the operation of the system without a reduction in the external pressure is of about 10 minutes duration whereas if the pressure is reduced, that this time may be extended to 30 minutes or more. At all times during the operation the pressure within the chamber is reducing thereby reducing the efficacy of operation of the spectrometer device. However, desirably the device is adapted to perform multiple scans of the sample such that a time-performance relationship may be analysed.

Once the internal pressure of the vacuum chamber is such that there is little or no pressure gradient across the membrane then the usefulness of the system is lost. The system may then be recycled by a reconditioning process. Such a process would involve the cleaning of all materials making up the device and the re-formation of a sealed vacuum within the chamber. Typically, the formation of the vacuum conditions are provided by assembling the system within a low pressure environment and sealing the vacuum chamber prior to removal from this low pressure environment. This clean room assembly ensures that the accuracy of the samples detected by the spectrometer is increased.

When assembling a system according to the present invention, desirably it is effected in one or more sequential steps. A MEMS spectrometer device is formed in accordance with known techniques and mounted on a PCB board. The board is then introduced, in vacuum conditions, into a steel chamber having an open entrance port at one end. The PCB board is mounted to an end of the chamber distal from the open port. A getter material is then introduced to the chamber. The membrane is then mounted across the internal diameter of the chamber. The open port is sealed by providing a removable or breakable seal or valve at the end of the chamber. Once the chamber is sealed it may then be removed from the vacuum conditions.

The words comprises/comprising when used in this specification are to specify the presence of stated features, integers, steps or components but does not preclude the presence or addition of one or more other features, integers, steps, components or groups thereof.

The invention claimed is:

1. A mass spectrometer system comprising a mass spectrometer device provided within a pre-evacuated chamber, the chamber having an entrance port through which a sample may be introduced into the chamber and into contact with the mass spectrometer device, the system additionally comprising a permeable membrane located across the chamber between the port and the spectrometer device and a valve located between the membrane and the entrance port and having a closed state and an open state, such that, in use, the adoption of the open state allows the flow of the sample into the chamber through the membrane and into contact with the spectrometer device and a reduction of the pressure differential across the membrane, the system further comprising a second evacuated chamber, the pre-evacuated chamber being located within the second evacuated chamber, the pressure within the pre-evacuated chamber being less than that of the second evacuated chamber.

2. The system as claimed in claim 1 wherein the spectrometer device is formed from a MEMS device.

3. The system as claimed in claim 1 wherein the valve is formed from a rupturable diaphragm sealing the evacuated chamber, the rupturing of the diaphragm breaking the seal and allowing the flow of the sample into the chamber.

4. The system as claimed in claim 1 wherein the valve is formed from a breakable glass member and an actuator, the glass member being located across the chamber and sealing the chamber, and wherein, in use, the actuator is adapted to come into contact with the glass member, breaking the member and consequently the seal.

5. The system as claimed in claim 1 wherein the membrane is formed from a polydimethylsiloxane material.

6. The system as claimed in claim 5 wherein the polydimethylsiloxane material is formed as a liquid layer on a substrate, a polymerisation of the material on the substrate forming the membrane.

7. The system as claimed in claim 6 wherein the substrate is a metal mesh structure.

8. The system as claimed in claim 6 wherein the substrate is a silicon based substrate.

9. The system as claimed in claim 1 wherein the second chamber includes an inlet and an outlet tube, the inlet tube being adapted to enable an introduction of a sample from outside the second chamber into contact with the spectrometer device located within the pre-evacuated chamber, the outlet tube being adapted to enable a venting of gas from the second chamber.

10. The system as claimed in claim 9 wherein a pump is provided on the outlet tube, the pump adapted to effect a reduction in pressure of the second chamber.

11. The system as claimed in claim 10 wherein the pressure within the second chamber is reduced to about $10^{-1}$ Torr.

12. The system as claimed in claim 1 wherein, in the normally closed position, the pressure within the pre-evacuated chamber is less than $10^{-4}$ Torr.

13. A mass spectrometer system comprising a mass spectrometer device provided within a pre-evacuated chamber, the pre-evacuated chamber being provided within a second evacuated chamber, the pressure within the pre-evacuated chamber being less than that of the second evacuated chamber, the pre-chamber having an entrance port through which a sample may be introduced into the pre-evacuated chamber and into contact with the mass spectrometer device, the system additionally including a permeable membrane located across the pre-evacuated chamber between the port and the spectrometer device and a permanently breakable seal located between the membrane and the entrance port and having an normally closed state when the seal is maintained and an open state when the seal is broken, such that, in use, breaking the seal allows the flow of the sample into the pre-evacuated chamber through the membrane and into contact with the spectrometer device and an increase in pressure within the evacuated chamber.

14. The system as claimed in claim 13 wherein the spectrometer device is formed from a MEMS device.

15. The system as claimed in claim 13 wherein the breakable seal is formed from a rupturable diaphragm sealing the pre-evacuated chamber, the rupturing of the diaphragm breaking the seal and allowing the flow of the sample into the pre-evacuated chamber.

16. The system as claimed in claim 13 wherein the breakable seal is formed from a breakable glass member and an actuator, the glass member being located across the pre-evacuated chamber and sealing the chamber, and wherein, in use, the actuator is adapted to come into contact with the glass member, breaking the member and consequently the seal.

* * * * *